US005441435A

United States Patent [19]

Shiraishi

[11] Patent Number: 5,441,435

[45] Date of Patent: Aug. 15, 1995

[54] TRACKWAY TOY

[75] Inventor: Hisashi Shiraishi, Tokyo, Japan

[73] Assignee: Tomy Company, Ltd., Katsushika, Japan

[21] Appl. No.: 216,048

[22] Filed: Mar. 22, 1994

[30] Foreign Application Priority Data

Mar. 24, 1993 [JP] Japan ..... 5-019426

[51] Int. Cl.[6] ..... A63H 18/00

[52] U.S. Cl. ..... 446/424; 446/428; 446/446; 446/476

[58] Field of Search ..... 446/424, 423, 427, 428, 446/435, 425, 444, 446, 475, 441, 471, 476

[56] References Cited

U.S. PATENT DOCUMENTS 4,100,696 7/1978 Ogasawara ..... 446/424 X
4,112,610 9/1978 Sano ..... 446/423
4,189,864 2/1980 Saito ..... 446/471 X
4,493,669 1/1985 Neuhierl ..... 446/441 X
4,582,500 4/1986 Hanson et al. ..... 446/423

FOREIGN PATENT DOCUMENTS 2005158 8/1971 Germany ..... 446/424

*Primary Examiner*—Mickey Yu
*Attorney, Agent, or Firm*—Staas & Halsey

[57] ABSTRACT

A trackway toy featuring a powered vehicle for movement along sections of track and action stations which may be in the form of an elevator and a crane in the vicinity of the trackway and provided with a movable structure for attracting the attention of the child, and a mechanism for stopping the vehicle at the action station and for using the power of the vehicle to activate movement of the movable structure of the action station.

5 Claims, 20 Drawing Sheets

TRACKWAY TOY

BACKGROUND AND SUMMARY OF THE INVENTION

The present invention relates to a trackway toy along which a vehicle moves through a series of amusement stations. The vehicle is provided with a motor for propelling the vehicle along the trackway. The vehicle is also provided with a plurality of "covers" or bodies which are selectively removed from and redeposited upon the moving vehicle. Turn-around sections are provided within the trackway permitting automatic reversal of the vehicle in a predetermined manner. The action stations include an elevator for receiving the powered vehicle wherein the power of the vehicle is directly transmitted through gears to a mechanism for raising and lowering the elevator. In similar manner, a crane is utilized at another amusement station, once again relying upon the power of the vehicle to operate same. The amusement value of the present invention is enhanced because of the aforementioned action stations taken singularly and in combination and as well by the realism achieved thereby.

DESCRIPTION OF THE PREFERRED EMBODIMENT

Figure 1:
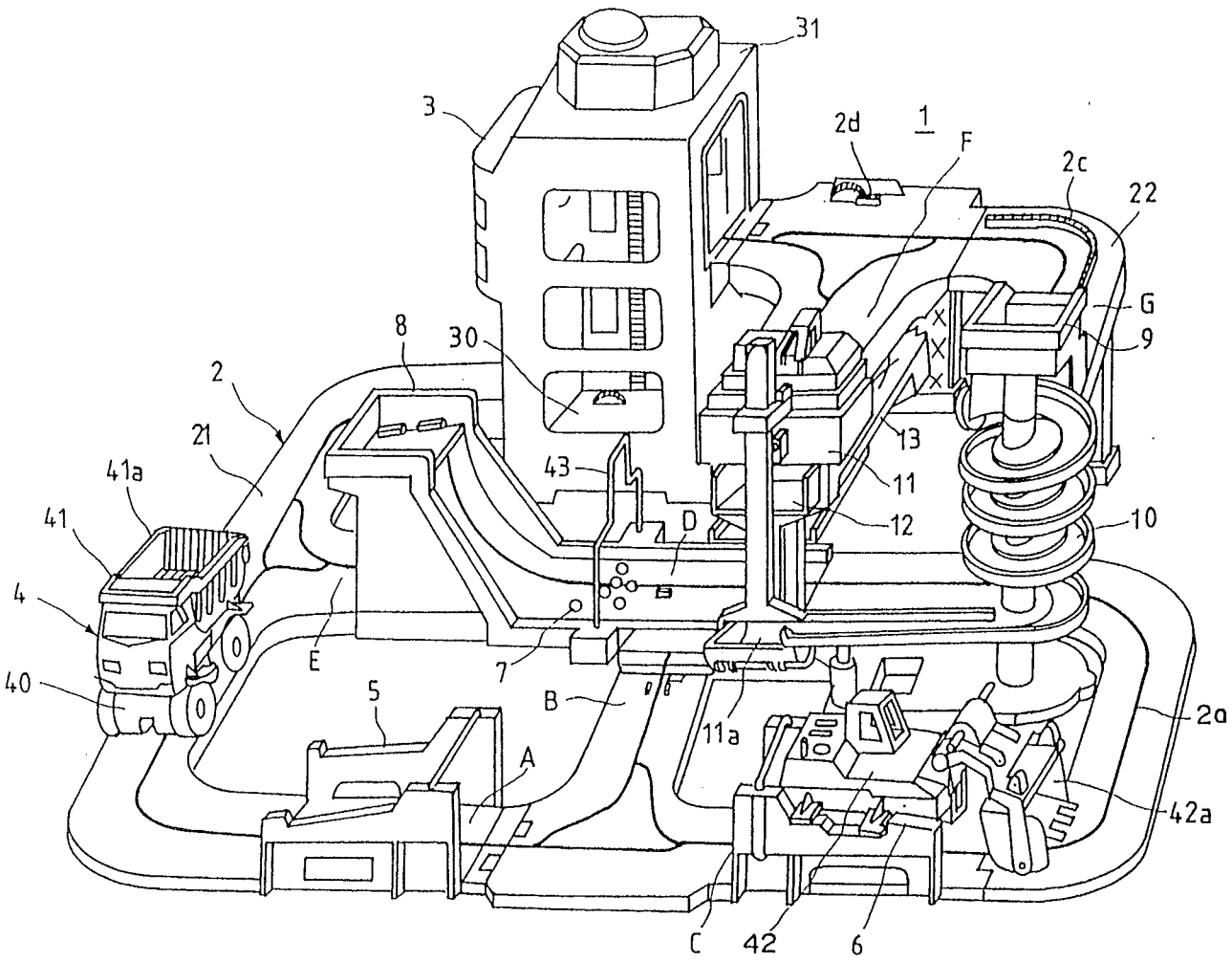
FIG. 1 is a perspective view of the trackway toy of the present invention.

The trackway toy 1 of the present invention, as seen in FIG. 1, features a trackway 2 which is provided with a guide groove *2a* (FIGS. 3 and 4) along the center portion thereof. The trackway 2 is provided with a lower track section 21 and a raised track section 22. The upper and lower track sections 21 and 22 are formed using straight, curved and branched sections.

The lower track section 21 and the upper track section 22 are connected by an upstanding elevator 3, as explained hereinafter.

Figure 3:
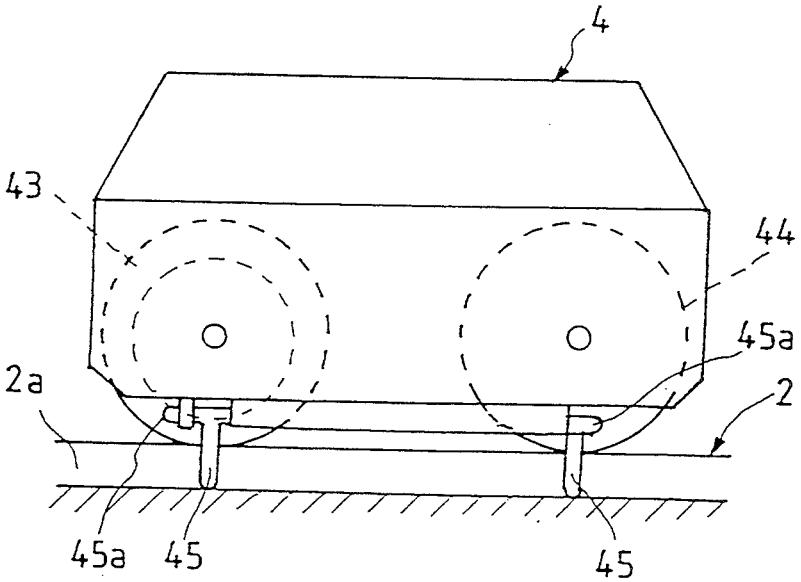
FIG. 3 is a left side elevational view of the bogie positioned on a section of track.
Figure 4:
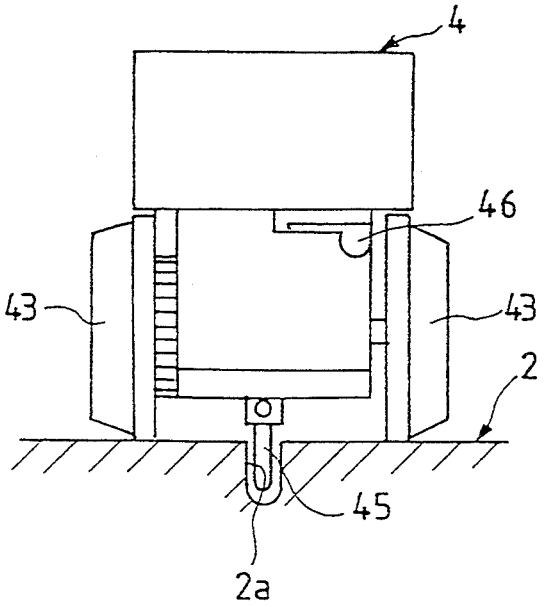
FIG. 4 is a front view of the bogie positioned on a section of track.

The reference numeral 4 designates generally a self-propelled vehicle or running car. The car 4, as seen in FIGS. 3 and 4, is provided with guide projections 45 on the underside thereof which engage the guide groove *2a* permitting the car 4 to run along the trackway 1.

The lower track 21 is provided with forward and backward switching sections A, B, C, D and E, while the upper track 22 is provided with similar switching sections F and G. The forward-backward switching sections A–G are each provided with a switch projection *2b* on one side of the groove *2a* (FIGS. 10, 11, 13 and 25).

The operation of the trackway toy will now be described. When the running car 4 advances from the position shown in FIG. 1 toward the car-body mounting-dismounting section 5, the cover or body 41 is dismounted at section 5 and the chassis 40 of the car 4 (hereinafter referred to as "bogie 40") advances to the switching section C where the direction of travel of the bogie 40 is switched from forward to backward. The bogie 40 thereafter moves backward to the forward-backward switch section B at which time the direction of travel is again reversed and the bogie 40 moves forward to the switch section A. The bogie 40 thereafter moves backward once again attempting to pass through the mounting-dismounting section 6 with the cover or body 42 mounted thereon. The running car 4 (comprised of the bogie 40 with the body 42 mounted thereon) moves toward the switching section D, at which time a collection of small balls 7 are scattered. These small balls 7 are scooped by a blade 42*a* mounted on the body 42 and are then loaded onto the freight loading section 8. The car 4 thereafter moves backwardly, returning to the mounting-dismounting section 6. The body 42 is dismounted when the car 4 passes through connection-disconnection section 6. The bogie 40 (the body 42 has been left behind) advances to the switch section B where the direction of travel of the bogie is switched again from forward to backward. The bogie 40 moves backward toward the dismounting section 5 where the body 41 is mounted. Then, the car 4 moves backward towards the switch section E. After loading the small balls 7 in the dump truck 41*a* at the loading section 8 provided at the switch section E, the car 4 moves forward toward the elevator 3, riding on the elevator carrier 30. The carrier 30 automatically goes upward until the upper surface of the carrier 30 is flush with the upper surface of the upper track 22. The car 4 leaves the elevator housing 31 and moves on to the upper track 22. The car 4 travels toward the switch section F where the car 4 starts moving backward to the switch section G. During this backward movement the speed of the car 4 is reduced. Immediately before arriving at the switch section G, the dump body 41*a* rises to discharge the balls 7 onto hopper 9. The balls which have entered the hopper 9 go downward along a spiral slide 10 entering bucket 11*a* of crane 11. At this time, the car 4 arrives at switch section G where the car 4 begins advancing toward elevator 3. Before reaching the elevator housing 31, the car 4 comes to a stop. Then, the bucket 11*a* of the crane 11 automatically rises, dumping the balls 7 from the bucket 11*a* into the discharge port 12. The balls 7 slide downward along slope 13 and scatter in the switch section D. In the meantime, the car 4 moves toward the elevator 3 entering the housing 31. The elevator carrier 30 goes down and when the upper surface of the carrier 30 becomes flush with the upper surface of the lower track 21, the car 4 leaves the elevator housing 31 and moves onto the lower track 21. The car 4 advances to the mounting-dismounting section 5, returning to the position shown in FIG. 1. It will be apparent that the operation just described is repeated over and over.

Figure 2:
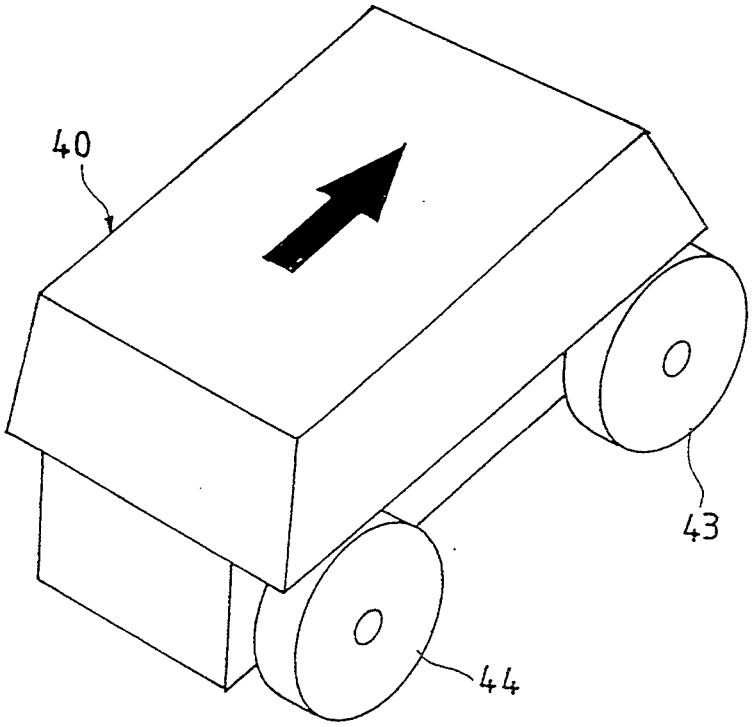
FIG. 2 is a perspective view of the bogie, i.e., the powered vehicle without one of several ornamental-operational covers.

The construction of the bogie 40 (the vehicle without the body or cover 41, 42) will now be described with reference to FIGS. 2 and 3. The bogie 40 is generally boxed-shaped in configuration and is provided with a pair of driving front wheels 43 and driven rear wheels 44. It is to be understood that when the covers or bodies 41 and 42 are mounted on the bogie 40, the resulting running car 4 moves in different directions such that with the body 41 mounted in position the front and rear of the bogie 40 correspond to the front and rear of the running car 4. However, when the body 42 is mounted on the bogie 40, the front and rear of the bogie 40 are opposite the front and rear of the running car 4.

The underside of the bogie 40 is provided with a pair of guide projections 45 which are independently rockable in a transverse direction with respect to the center of a shaft 45*a*. The pair of guide projections 45 engage the guide grooves 2*a* provided in the track 2. There is also provided on the front face of the bogie 40 a power switch 46.

Figure 5:
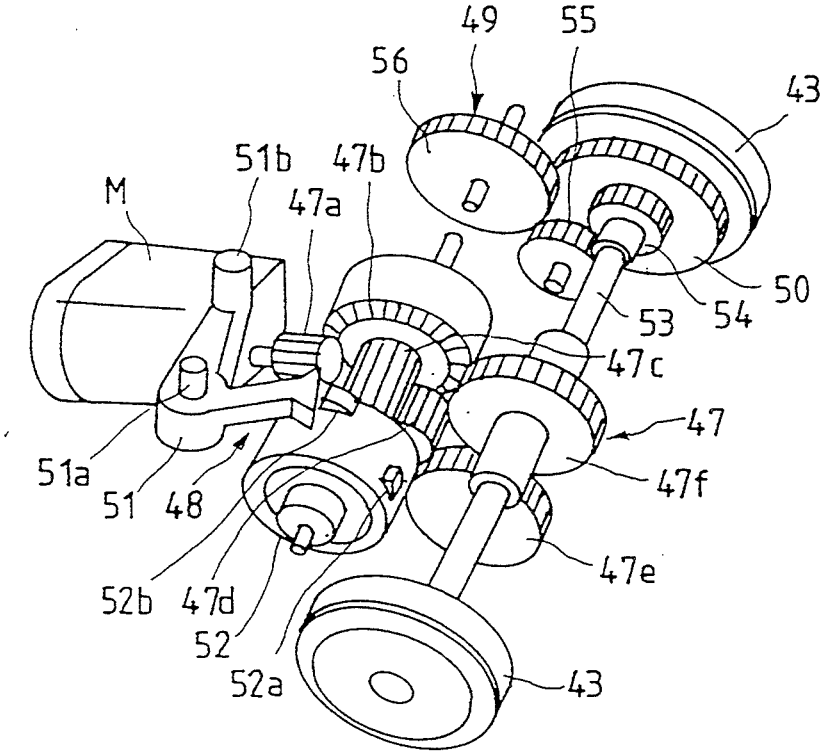
FIG. 5 is a perspective view of the operating mechanism of the bogie.

The bogie 40, as seen in FIG. 5, is provided with a battery (not shown), a motor M, a mechanism 47 for driving the pair of driving wheels 43, a gear change mechanism 48 for switching between forward and backward directions, a speed reducing mechanism 49 for changing the running speed, and a drive gear 50 which is used to drive the elevator 3 and the crane 11.

The drive mechanism 47 consists of a pinion 47*a* which is mounted on the motor shaft, a crown gear 47*b* which meshes with the pinion 47*a*, a sun gear 47 which rotates as one body with the crown gear 47*b*, a planetary gear 47*d* which meshes with the sun gear 47*c*, and gears 47*e* and 47*f* selectively engagable with the planetary gear 47*d* and enmeshed with each other with the rotation of the planetary gear 47*d*. The front wheels 43 of the bogie 40 are driven by these gear trains.

Figure 6:
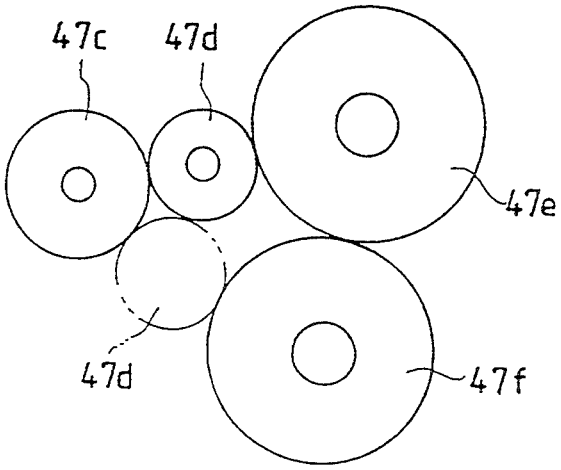
FIG. 6 is a right side schematic view showing the engagement of gears of the operating mechanism of the bogie.

The gear change mechanism 48 consists of an L-shaped lever 51 which rocks on the center of the shaft 51*a*. and a drum 52 which is provided with pawls 52*a* and 52*b* which support the shaft of the planetary gear 47*d* and which can rotate idle. The operating part 51*b* of the lever 51 in the gear change mechanism 48 protrudes from the underside of the bogie 40. The protruding position of the operating part 51*b* is located a little to the right of the center line of the underside of the bogie 40, so that it will contact a switch projection 2*b* in the direction of travel on the track 2 to operate the lever 51. In this case, the direction of operation of the lever 51 depends upon the direction of contact with the direction switch projection 2*b*. Before and after contact, the pawls 52*a* and 52*b* which engage the lever 51 are changed. Also, which one of the gears 47*e* and 47*f* the planetary gear 47*d* will engage depends upon which one of the pawls 52*a* and 52*b* the lever 51 will engage (see FIG. 6). In this case, when the planetary gear 47*d* has come into mesh with the gear 47*e*, a pair of driving wheels 43 rotate in the normal direction (in the direction of movement indicated by the arrow on the upper surface of the bogie 40). When the planetary gear 47*d* has come into mesh with the gear 47*f* , the driving wheels 43 rotate in the reverse direction.

The speed reducing mechanism 49 consists of a gear 54 provided on the driving shaft 53, an idle gear 55 in mesh with the gear 54, and a gear 56 in mesh with the idle gear 55. Of these gears, the gear 56 meshes with racks 2*c* and 2*d* formed on the track 2. In these rack sections the driving wheels 43 of the running car 4 are released from a grounded condition, and accordingly, the running car 4 is driven with a reaction force produced by the rotation of the gear 56 on the racks 2*c* and 2*d*.

The drive gear 50 is for moving downwardly the elevator carrier 30 and the bucket 11*a* of the crane 11, and is designed to mesh with gears 36 and 37 (FIG. 15) provided on the elevator carrier 30 and with a gear 14*a* (FIG. 25) located on the right side of the elevator housing 31.

Figure 7:
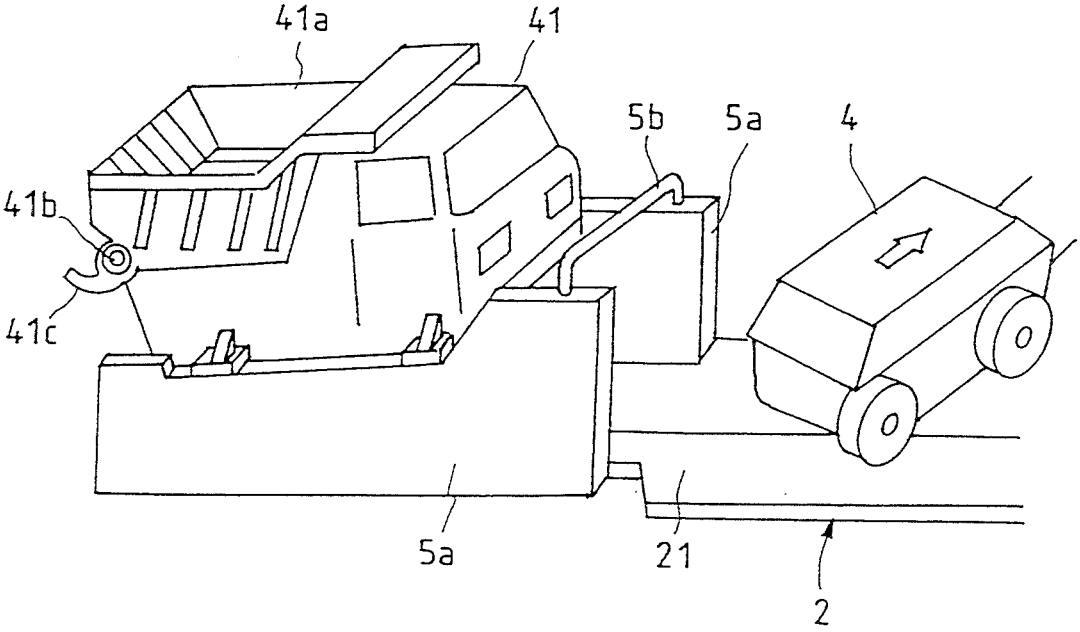
FIG. 7 is a perspective view of the mounting-dismounting section of the track with an ornamental-operational cover retained thereon and the bogie departing therefrom.

The covers or bodies 41 and 42, which ride on the bogie 40 to form the running vehicle 4, will now be described. As seen in FIG. 7, the body 41 is configured as a dump truck having a dumping portion 41*a* which swings up and down about the center of the shaft 41*b*. On the right rear end of the dump body 41*a* there is provided an operating lever 41*c*.

Figure 8:
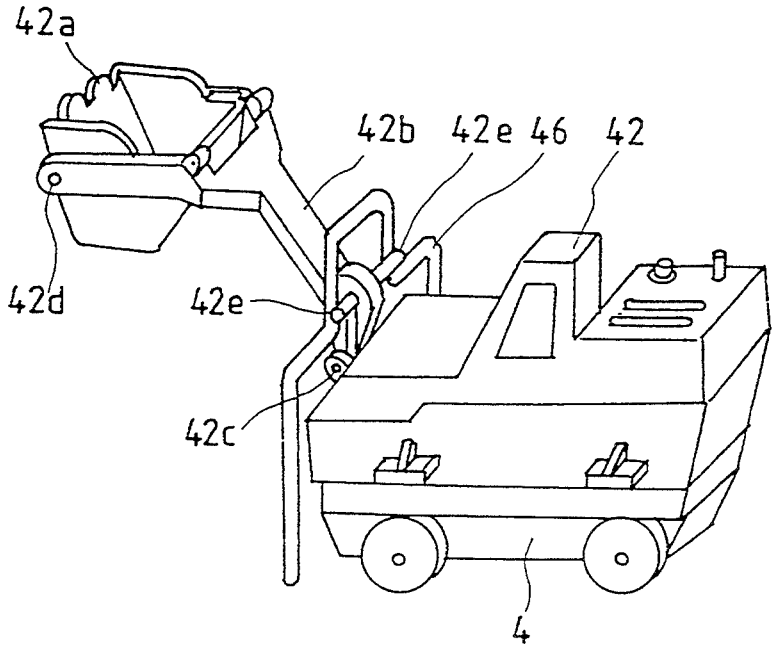
FIG. 8 is a perspective view of one of the two ornamental-operational covers configured as a bulldozer and its operating parts.
Figure 9:
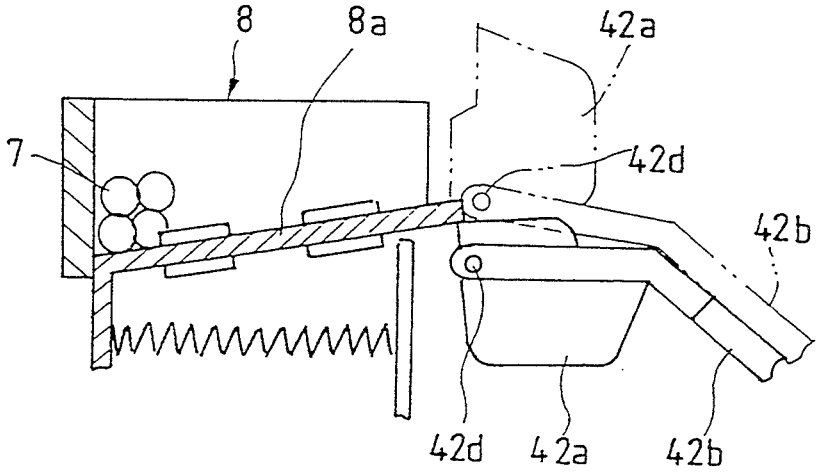
FIG. 9 is a side view, partly in section, illustrating operation of the bulldozer.

The body 42 which is configured as a bulldozer is illustrated in FIG. 8. The blade 42*a* provided on the forward end of the arm 42*b* is designed to swing about the center of the shaft 42*d*. The arm 42*b*, when loaded, is held by weight in a lowered position as shown in FIG. 1 at which time the blade 42*a* opens forwardly. The arm 42*b* is generally T-shaped in configuration and is designed to move upward when engaged with the stopper 46 provided upright in the vicinity of the forward-backward switch section D. That is, when the running car 4 goes under the stopper 46, the pin 42e provided on the arm 42*d* is stopped by the narrow part of the stopper 46, thus moving the arm 42*b* upward about the center of the shaft 42*c*. At this time, the small balls 7 are scooped by the blade 42*a* at the forward edge of the arm 42*b*. The blade 42*a* is designed to turn upward when it contacts the underside of the rear end of the movable plate 8*a* which forms the top plate of the freight loading section 8. That is, as shown in FIG. 9, when the tip of the blade 42*a* contacts the underside of the rear end of the movable plate 8*a* in the course of the upward movement of the arm 42*b* to thereby further raise the arm 42, the blade 42*a* swings about the center of the shaft 42*d*, as designated by the dotted lines in FIG. 9. When the blade 42*a* thus swings, the small balls are discharged on to the movable plate 8*a*.

The mounting-dismounting body sections 5 and 6 will now be described. The car body mounting-dismounting section 5, as shown in FIG. 7, has a lock bar 5*b*, which is bridged across a pair of support plates 5*a* set on both sides of the track 2. The upper surface of either of the support plates 5*a* is inclined to facilitate the mounting and dismounting of the body 41. The mounting-dismounting section 6 is generally of similar construction to the mounting-dismounting section 5, as shown in FIG. 1, and facilitates the mounting and dismounting of the body 42.

Figure 10:
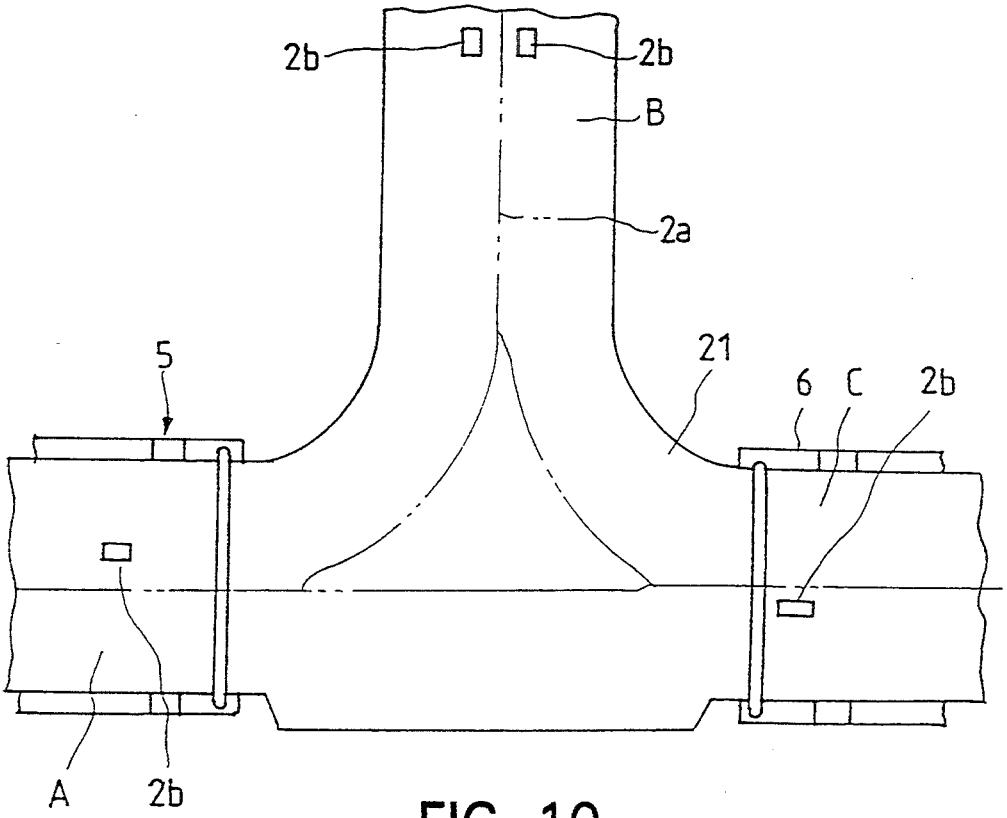
FIG. 10 is a plan view of a portion of the track.

Forward-backward switch sections A, B and C will now be described. The track 2 at the location of the forward-backward switch sections A, B and C is constructed as shown in FIG. 10. Each of the forward-backward switch sections A, B and C is provided with a direction switch projection 2*b* on one or both sides of the guide groove 2*a*. When the operating part 51*b* located on the underside of the bogie 40 comes in contact with the direction switch projection 2*b*, the bogie 40 switches the direction of travel between forward and backward. That is, the bogie 40 that has come from the mounting-dismounting section 5 side advances as far as the forward-backward switch section C, where the bogie 40 starts moving backward entering the forward-backward switch section B. Also at the forward-backward switch section B, the direction of travel is changed from backward to forward, allowing the bogie 40 to go into the forward-backward switch section A. Here the direction of travel is changed to move the bogie 40 again to the forward-backward switch section C. This time the bogie 40 passes through the forward-backward switch section C. The guide groove 2*a* insures smooth performance of the operation described above.

Figure 11:
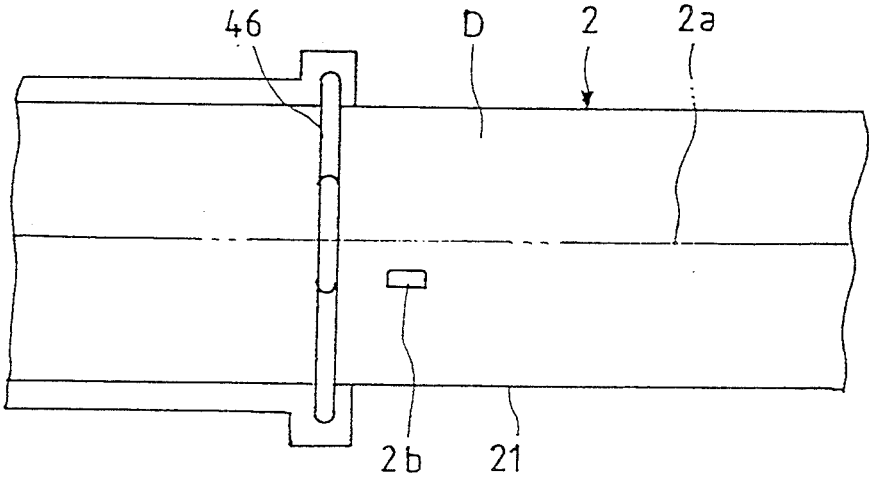
FIG. 11 is a plan view of a portion of the track.

The forward-backward switch section D will now be described. The track 2 at the location of the forward-backward switch section D is constructed as shown in FIG. 11. In the forward-backward switch section D there is provided a direction switch projection 2*b* on one side of the guide groove 2*a*. When the operating part 51*a* of the lever 51 of the running car 4 touches the direction switch projection 2*b*, the direction of travel of the running car 4 is changed from forward to backward. The operating part 51*b* touches the direction switch projection 2*b* after the discharge of the small balls 7 from the blade 42*a* on to the movable plate 8*a*.

Figure 12:
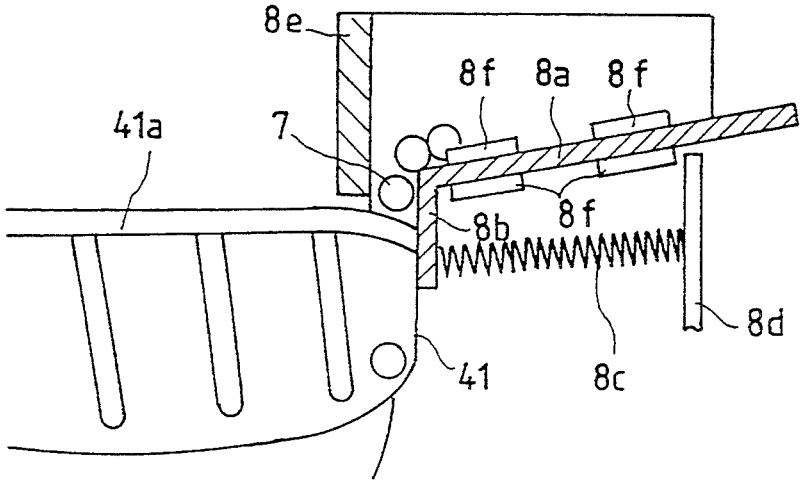
FIG. 12 is a side view, partly in section, illustrating operation of the freight loading section of the trackway toy.

The freight loading section 8 will now be described. In the freight loading section 8, as shown in FIG. 12, the movable plate 8*a* is L-shaped in longitudinal section, and is constantly pulled forward by a spring 8*c* positioned between the operating part 8*b* provided at the forward end of the movable plate 8*a* and a rear wall 8*d* of the freight loading section 8. The movable plate 8*a* moves backward when the operating part 8*b* is pushed backward by the rear end of the running car 4, allowing the small balls 7 to drop into the dump body 41*a* through a gap formed between the front wall 8*e* and the movable plate 8*a*. In FIG. 12, the reference numeral 8*f* designates a guide section for guiding the movable plate 8*a*.

Figure 13:
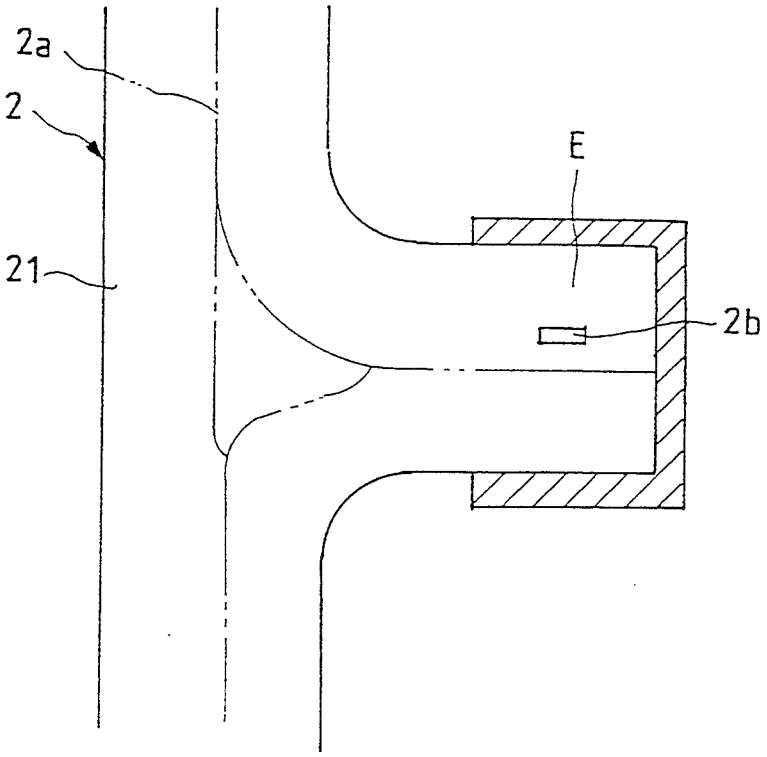
FIG. 13 is a plan view of a portion of the track.

The forward-backward switch section E will now be described. The track 2 at the forward-backward switch section E is constructed as shown in FIG. 13. In the forward-backward switch section E is provided the direction switch projection 2*b* on one side of the guide groove 2*a*. When the operating part 51*b* of the lever 51 of the running car 4 touches the direction switch projection 2*b*, the direction of travel of the running car 4 is changed from backward to forward. In this case, it is set such that the operating part 51*b* contacts the direction switch projection 2*b* immediately after the small balls 7 are discharged from the movable plate 8*a* into the dump body 41*a*. The track 2 preceding the forward-backward switch section E is designed to guide the running car 4 to the forward-backward switch section E when the running car 4 comes from the mounting-dismounting section 5 side, and to guide the running car 4 to the mounting-dismounting section 5 side without entering the forward-backward switch section E when the running car 4 comes from the elevator 3 side.

Figure 14:
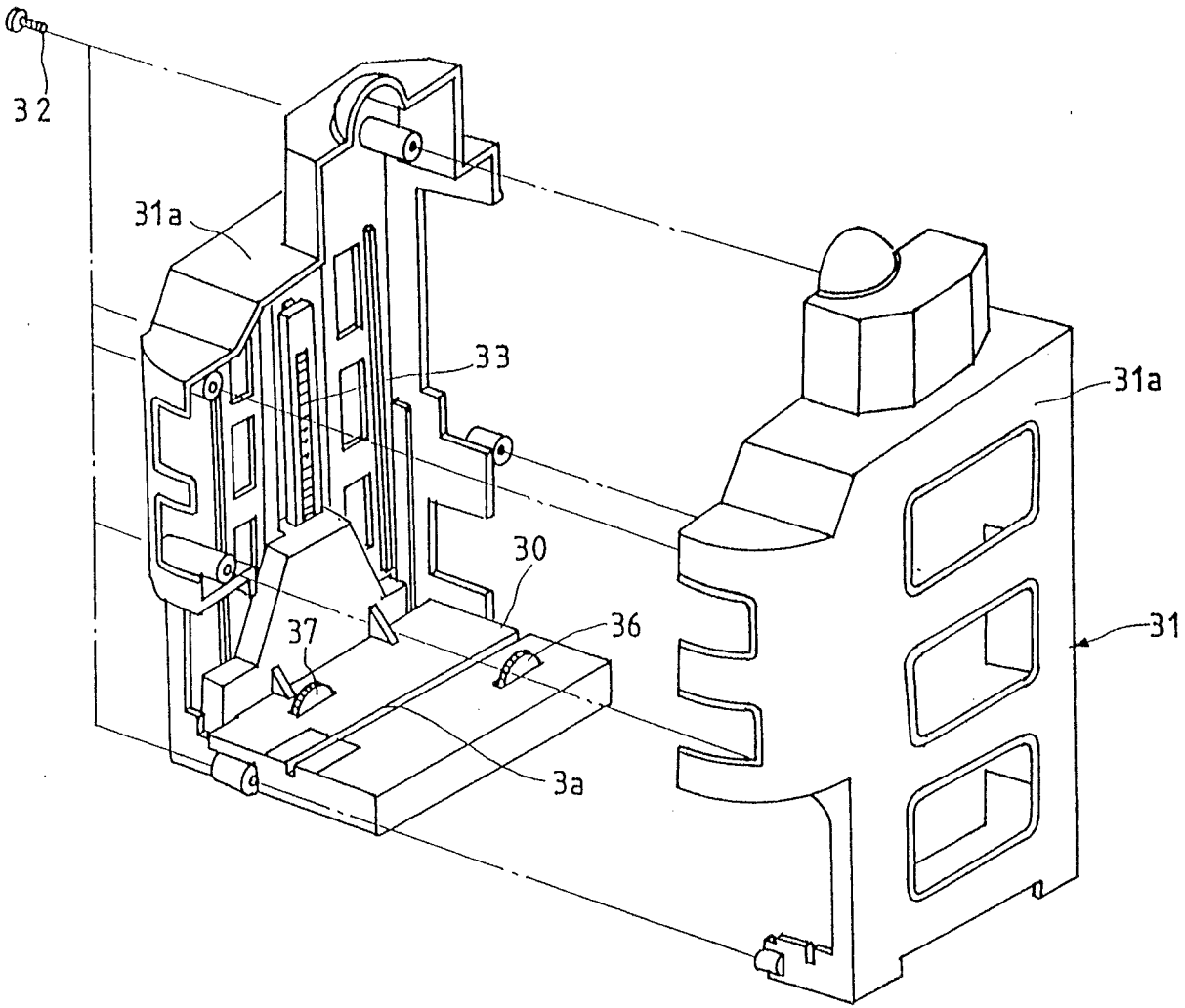
FIG. 14 is an exploded perspective view of the elevator of the trackway toy.

The elevator 3 will now be described. The elevator 3, as shown in FIG. 14, consists of the elevator lifting carrier 30 and the elevator housing 31 supporting the carrier 30.

The elevator housing 31 is designed to be separable into two halves, right and left. The right and left frames 31*a*, 31*a* are designed to be assembled by tap screws 32. On the inside surface of the frame 31*a* on one side is installed a vertically extending rack 33. The part where the rack 33 is provided protrudes in the form of the letter T from the inside surface of the frame 31*a*. The upright part of the elevator carrier 30 engages with the rack 33 as if hugging the flange part on the forward end thereof.

Figure 15:
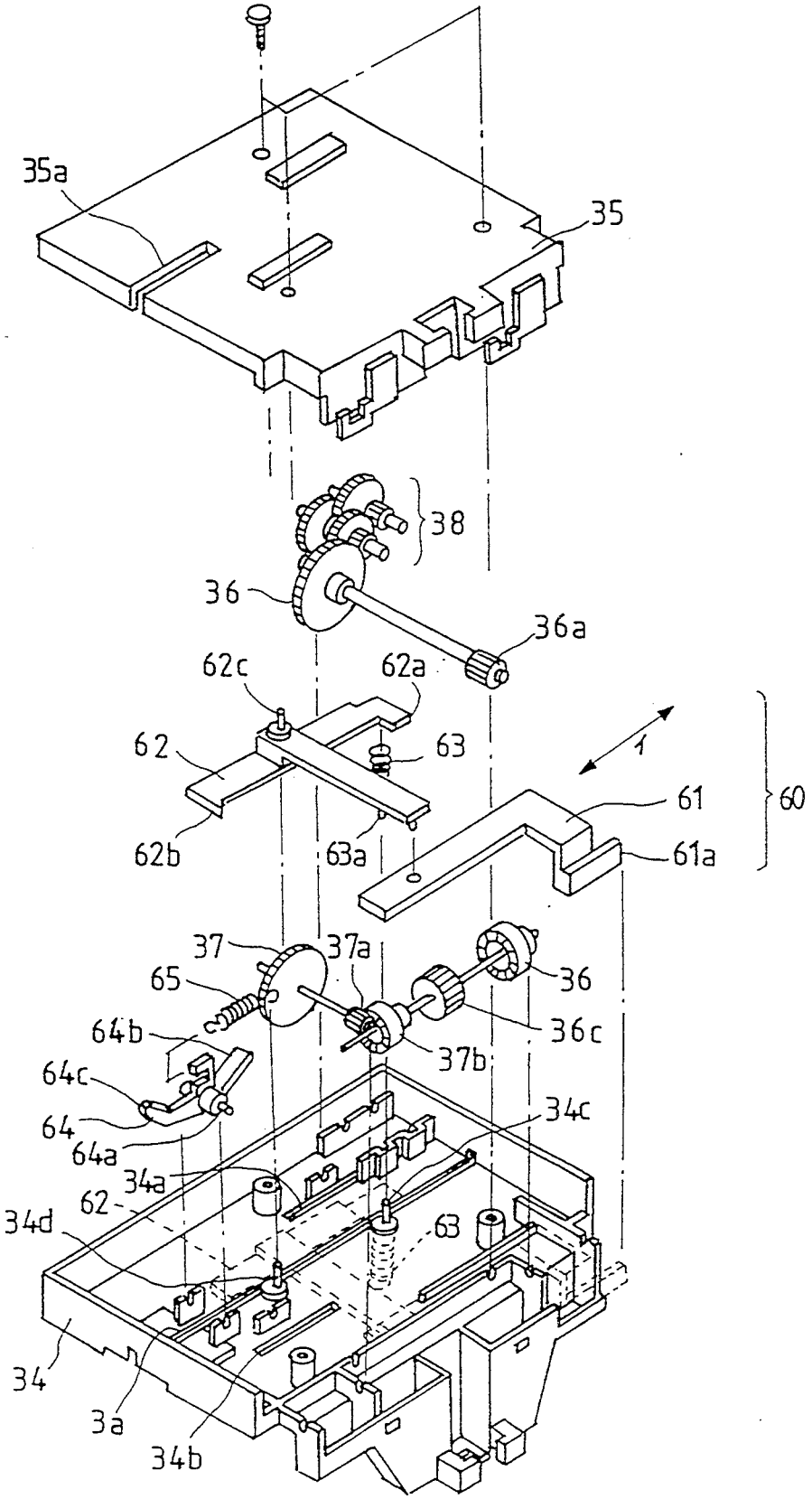
FIG. 15 is an exploded perspective view of the operating mechanism of the elevator.
Figure 16:
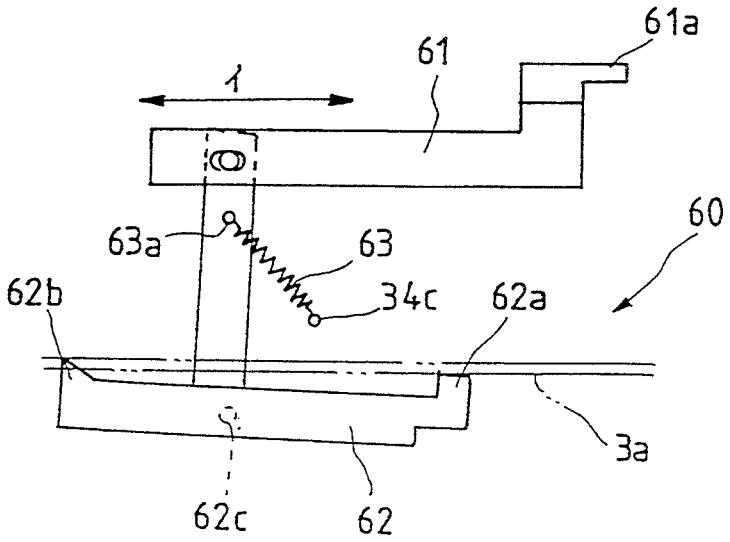
FIG. 16 is a plan view of the stopper mechanism in the elevator carrier.

The elevator carrier 30, as shown in FIG. 15, consists of an upper carrier body 34 and a lower elevator carrier base 35. The elevator carrier body 34 has a guide groove 3*a* which can be connected with the guide groove 2*a* of the track 2, and slits 34*a* and 35*b* (FIG. 15). From the slit 34*a* a part of a descent gear 37 protrudes (FIG. 14). The ascent gear 36, as shown in FIG. 15, is connected to the rack 33 through a pinion 36*a*, a crown gear 36*b* and a pinion 36*c*. The descent gear 37 is connected to the rack 33 through a pinion 37*a*. a crown gear 37*b* and a pinion 36*c*. The ascent gear 36 is additionally provided with a governor mechanism 38 consisting of a gear train, for the purpose of adding a specific resistance to the ascent gear 36. There is also disposed in the elevator carrier 30 a stopper mechanism 60 capable of stopping the running car 4. This stopper mechanism 60 consists of an L-shaped link 61 having a stop projection 61*a*, and a T-shaped link 62 having pawls 62*a* and 62*b*, as shown in FIG. 16. The link 61 is movable in the direction of the arrow a, and the link 62 is connected to the link 61 by a pin inserted in a pin hole of the link 61, so that the link 62 can swing on the center of the shaft 62*c*. A spring 63 is installed between a spring retaining projection 63*a* and a stationary part 34*c* of the elevator carrier body 34. A projection 61*a* of the link 61 protrudes out of the elevator carrier body 34.

Within the elevator carrier 30 is provided a seesaw member 64 which can rock on the center of the shaft 64*a*, as shown in FIG. 15. A stopper 64*b* provided on one end of this seesaw member 64 is designed to engage a guide projection 45 on the underside of the running body 4. An operating part 64*c* on the other end of the seesaw member 64 protrudes through a slit 35*a* in the elevator carrier base 35. Installed between the seesaw member 64 and a stationary part 34*d* of the elevator carrier body 34 is a spring 65, by which the operating part 64*c* of the seesaw member 64 is constantly pulled to protrude through the slit 35*a*.

Figure 17:
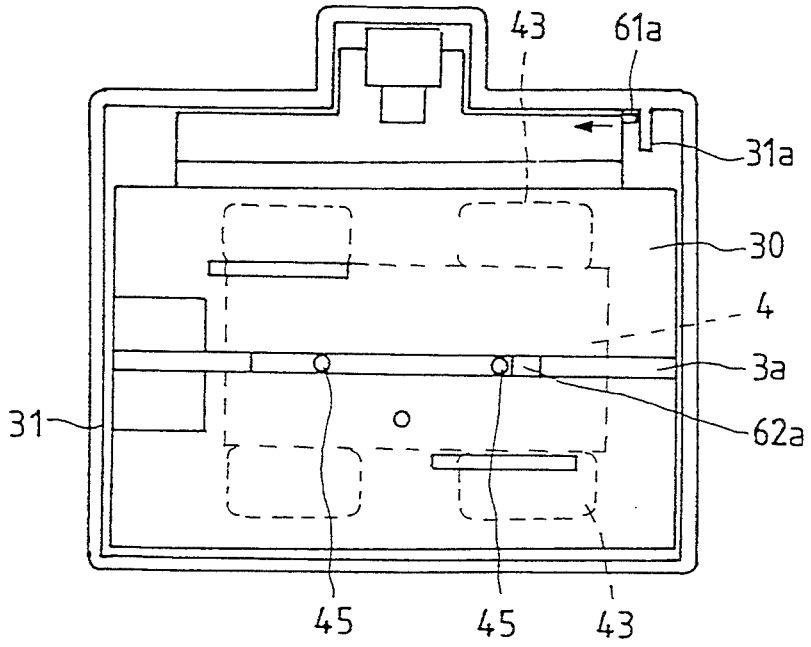
FIG. 17 is a plan view of the elevator carrier.
Figure 18:
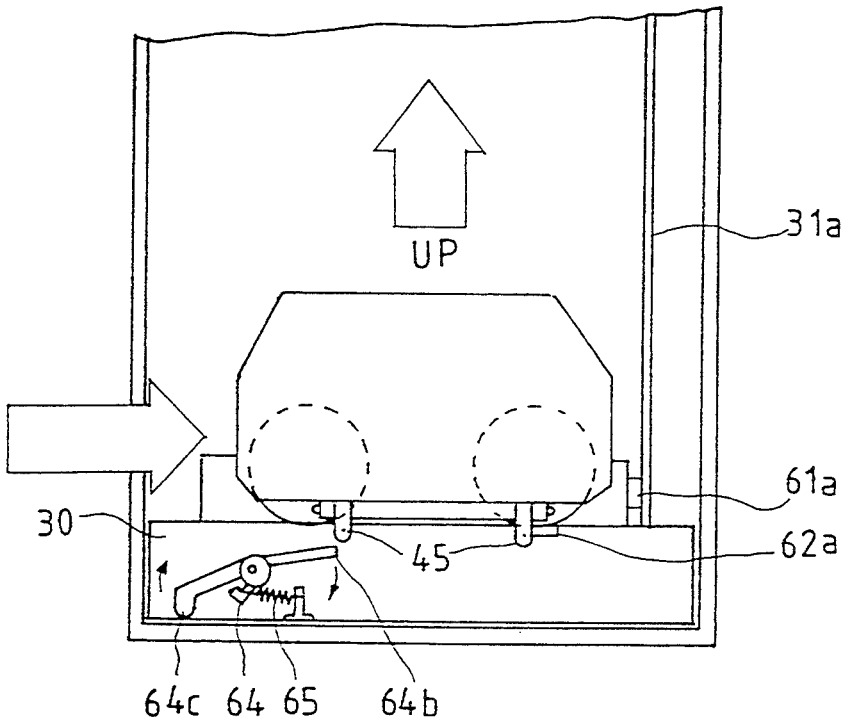
FIG. 18 is a side view of the elevator carrier with the running toy is in the bottom position.
Figure 19:
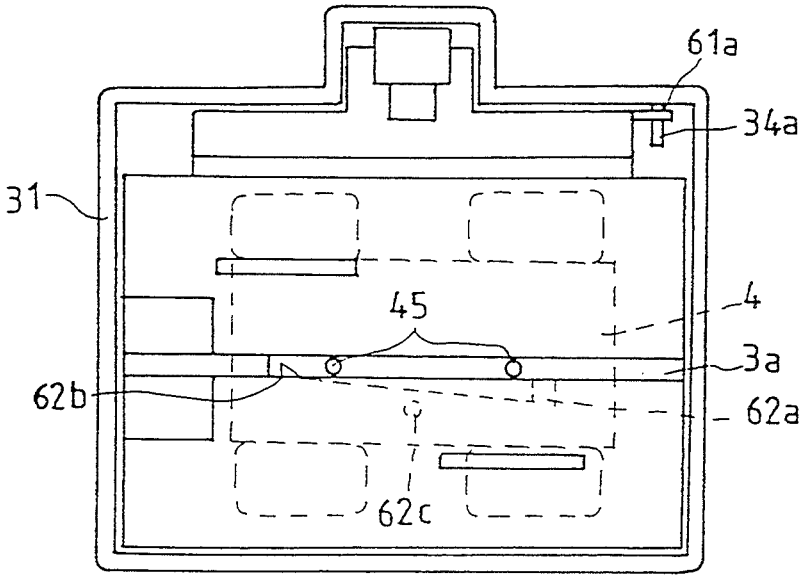
FIG. 19 is a plan view of the elevator carrier with the running toy is in the top position.
Figure 20:
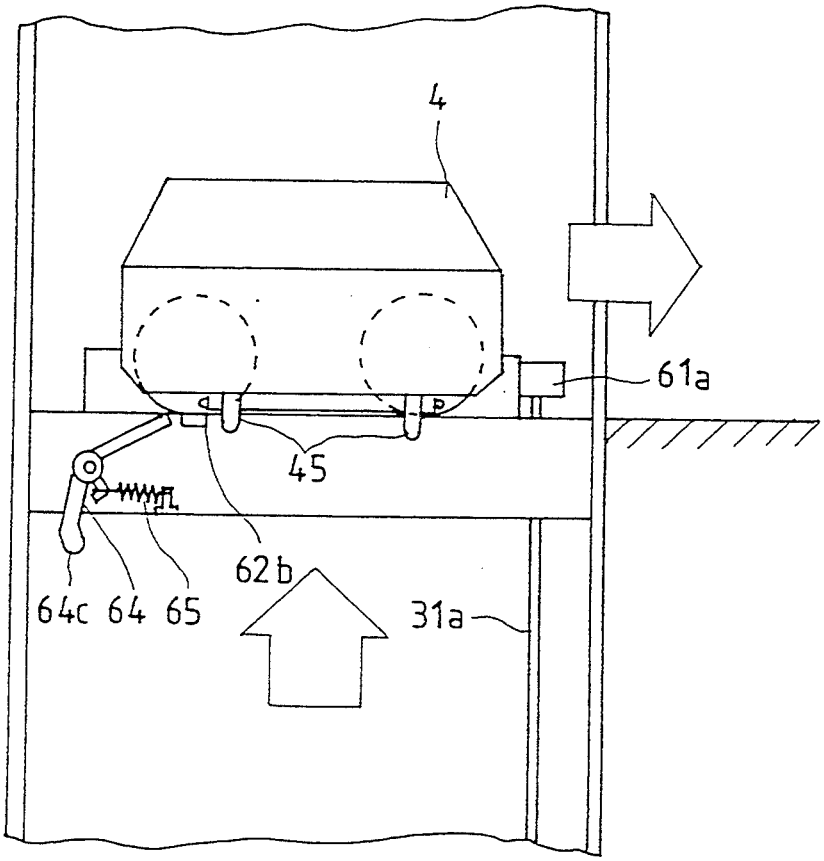
FIG. 20 is a side view of the elevator carrier with the running toy in the top position.
Figure 24:
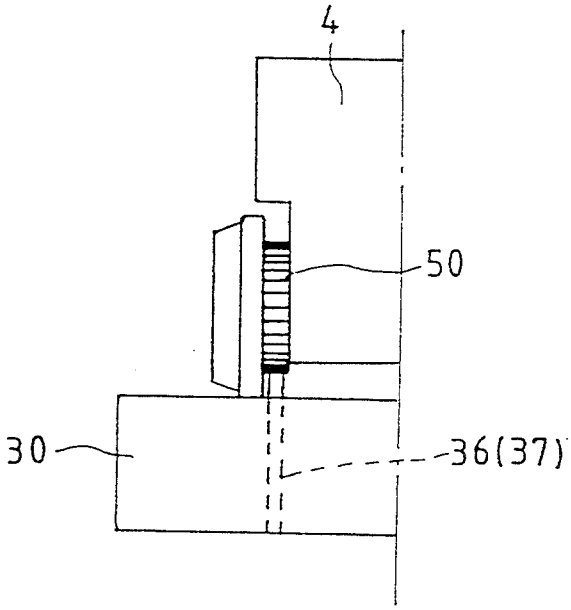
FIG. 24 is a schematic view illustrating the running toy in engagement with the ascent-descent gear.

The mode of operation of the elevator 3 will now be explained. As shown in FIGS. 17 and 18, when the elevator carrier 30 is in the bottom position, the operating part 64*c* of the seesaw member 64 is in contact with the bottom of the elevator housing 31, waiting in the elevator carrier 30. That is, the stopper 64*b* of the seesaw member 64 is not engaged with the outer side of the pawl 62*b* of the link 62. In the meantime, the stop projection 61*a* is in contact with the inner surface of a stop plate 31*a*, staying with the elevator carrier 30. Therefore, when the elevator carrier 30 is in the bottom position, the pawl 62*b* has retreated from the guide groove 3*a*, while the pawl 62*a* is protruding into the guide groove 3*a*. In this state, when the running car 4 rides from the left on to the elevator carrier 30, the front guide projection 45 located on the underside of the running car 4 engages with the pawl 62*a*, thus stopping the running car 4. At this time, as shown in FIG. 24, the drive gear 50 meshes with the ascent gear 36. Then, the turning power of the drive gear 50 is transmitted to the ascent gear 36, the pinion 36*a*, the crown gear 36*b* and the pinion 36*c*, thereby turning the pinion 36*c*. The pinion 36*c*, therefore, rotates on the rack 33, moving the elevator carrier 30 upward. When the elevator carrier 30 has moved up to the top position, the stop plate 31*a* is released, permitting the stop projection 61*a* to jump out by the force of the spring 63. The stop projection 61*a* engages the top end of the stop plate 31*a* (FIG. 19). At this time, the link 62 is rocked on the center of the shaft 62*c* by the operation of the link 61, withdrawing the pawl 62*a* from the guide groove 3*a* and stopping the rotation of the gear 36. The running car 4, therefore, moves from the elevator housing 30 out on to the upper track 22. In the meantime, with the rocking motion of the link 62 the pawl 62*b* protrudes out into the guide groove 3*a*, as shown in FIGS. 19 and 20.

Figure 21:
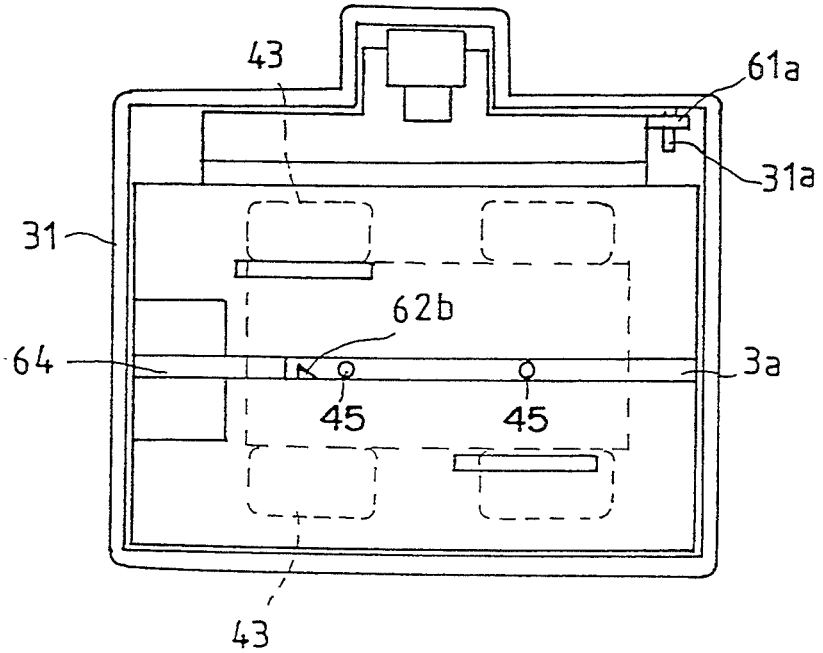
FIG. 21 is a plan view of the elevator carrier with the running toy in the top position.
Figure 22:
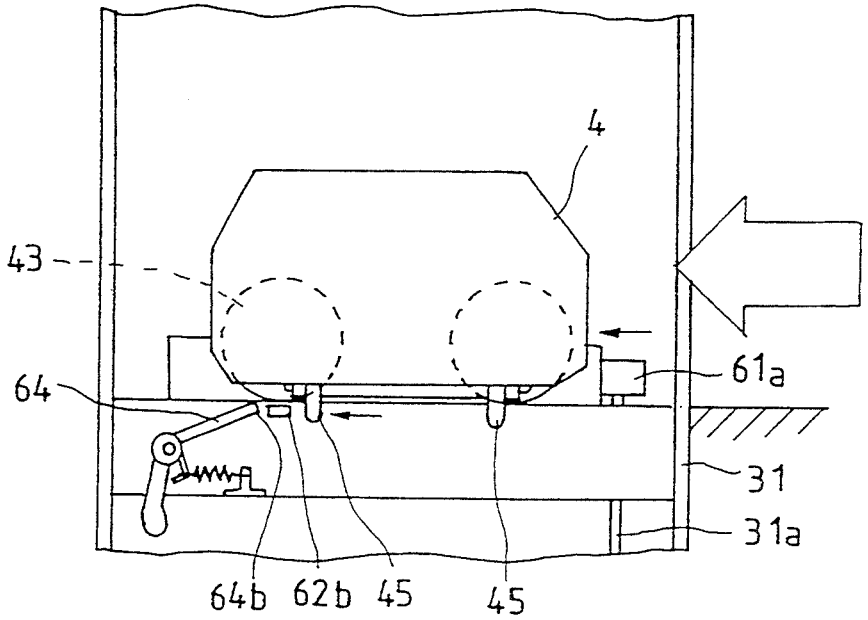
FIG. 22 is a side view of the elevator carrier with the running toy in the top position.
Figure 23:
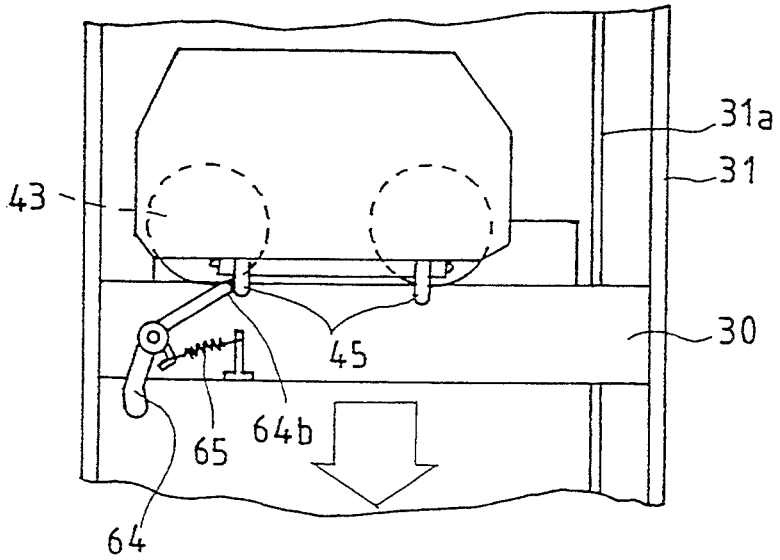
FIG. 23 is a side view of the elevator carrier with the running toy descending therein.

The downward movement of the elevator carrier 30 will now be explained. As shown in FIGS. 21 and 22, when the running car 4 rides from the right on to the elevator carrier 30, the front guide projection 45 located on the underside of the running car 4 contacts the pawl 62*b*. Since the inside of the pawl 62*b* has an inclined surface, the pawl 62*a* gradually withdraws from inside the guide groove 3*a* with the entrance of the running car 4. Thus the link 62 rocks on the center of the shaft 62*c* to operate the link 61, thereby releasing the stop projection 61*a* of the link 61 from the top end of the guide plate 31*a*. In this state, the pawl 62*a* comes in contact at its outer side with the stopper 64*b* of the seesaw member 64. On the other hand the projection 45 on the underside of the running body 4 hits on the stopper 64*b* of the seesaw member 64, stopping the forward movement of the running car 4. At this time, as shown in FIG. 24, the drive gear 50 engages the descent gear 37. Then the turning force of the drive gear 50 is transmitted to the descent gear 37, the pinion 37*a*. the crown gear 37*b* and the pinion 36*c*. The pinion 36*c*, therefore, rotates on the rack 33, moving the elevator carrier 30 downward by its reaction force (FIG. 23). When the elevator carrier 30 has come down to the bottom position, the operating part 64*c* of the seesaw member 64 contacts the bottom of the elevator housing 31 in the elevator carrier 30. That is, the stopper 64*b* of the seesaw member 64 is disengaged from the projection 45 located on the underside of the running body 4. Also, the gear 37 stops rotating, and the running car 4 goes out on to the lower track 21 from the elevator housing 31.

Figure 25:
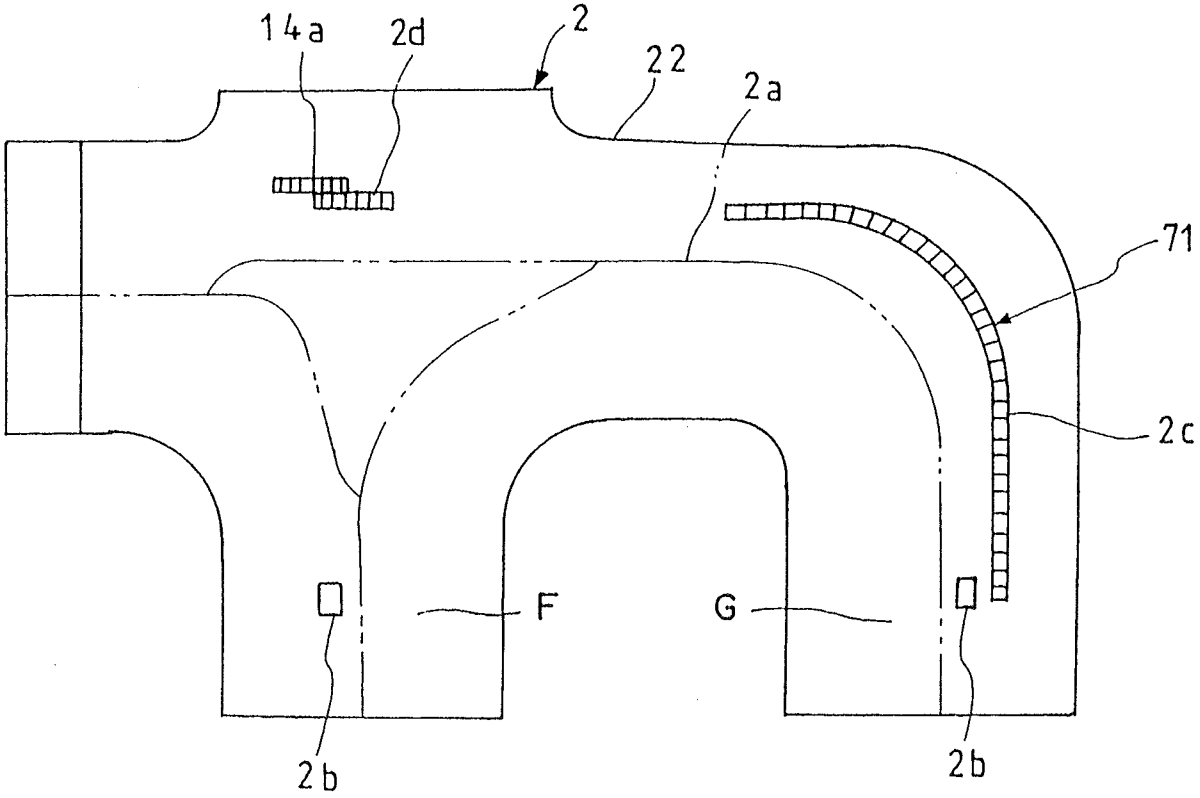
FIG. 25 is a plan view of a portion of the track.

The forward-backward switch section F will now be described. The track 2 at the location of the forward-backward switch section F is constructed as shown in FIG. 25. The forward-backward switch section F is provided with the direction switch projection 2*b* on one side of the guide groove 2*a*. When the operating part 51*b* of the lever 51 of the running car 4 contacts the direction switch projection 2*b*, the direction of travel of the running car 4 is switched from forward to backward. The track 2 located behind the forward-backward switch section E is constructed to guide the running car 4 to the forward-backward switch section E side when the running car 4 comes from the elevator 3 side, and to guide the running car 4 to the elevator side without entering the forward-backward switch section E when the running car 4 comes from the hopper 9 side.

The speed reducing section 71 will now be described. In the speed reducing section 71 there is formed a rack 2*c* along the guide groove 2*b* on one side of the guide groove 2*b* of the track 2, as shown in FIG. 25. The rack 2*c* is designed to engage the gear 56 of the running car 4, to thereby raise the driving wheels 43 of the running car 4 into engagement with the gear 56, which drives the running car 4.

Figure 26:
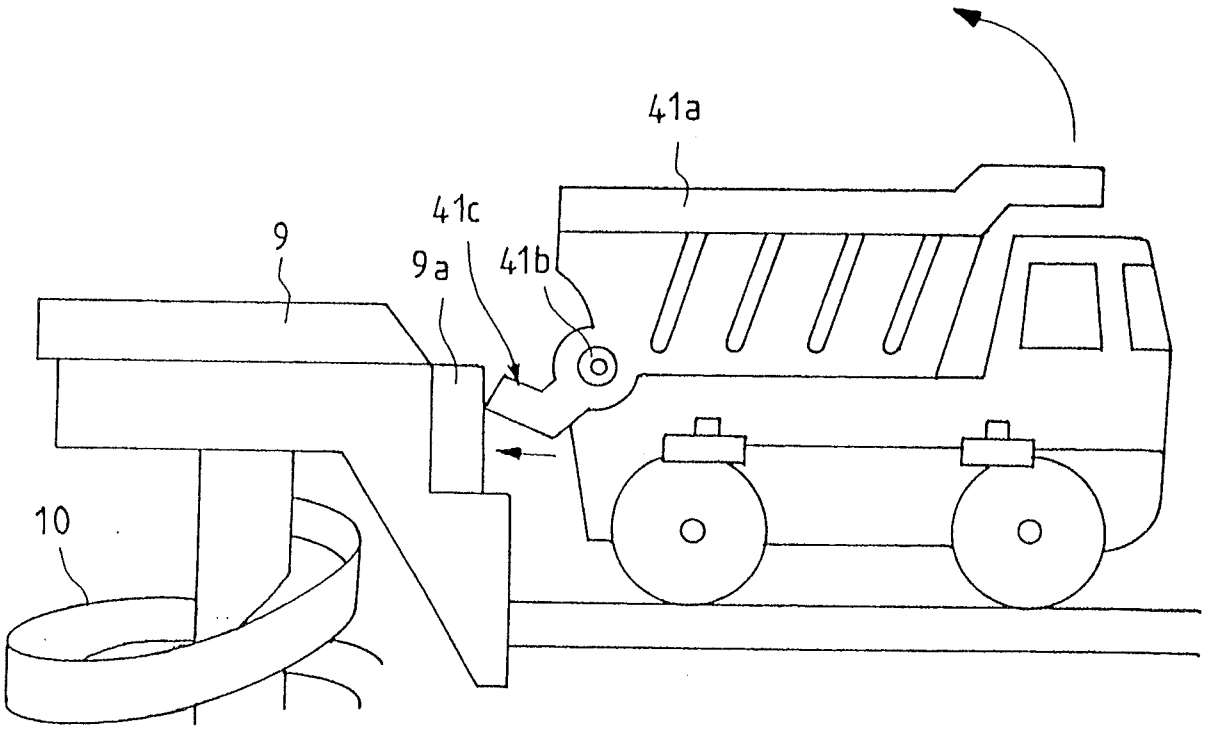
FIG. 26 is a side view of the hopper and its relationship to the running toy.

The hopper 9 will now be described. Under the hopper 9 is installed a spiral slideway 10, as shown in FIGS. 1 and 26. The lower end of the slideway 10 extends to the bottom end position of the crane 11 and the bucket 11*a* where the small balls 7 are transferred into the bucket 11*a*. In the hopper 9, as shown in FIG. 26, there is formed a contact part 9*a* which the operating part 41*c* of the dump body 41*a* of the dump truck contacts. When the operating part 41*c* contacts the contact part 9*a*, the dump body 41*a* is operated to unload the small balls 7.

The forward-backward switch section G will now be described. The track 2 at the location of the forward-backward switch section G is constructed as shown in FIG. 25. The forward-backward switch section G is provided with a direction switch projection 2*b* on one side of the guide groove 2*a*. When the operating part 51*b* of the lever 51 of the running car 4 touches the direction switch projection 2*b*, the direction of travel of the running car 4 is changes from backward to forward. In this case, the contact between the operating part 51*b* and the direction switch projection 2*b* is set to be performed after the unloading of the small balls 7 from the dump body 41*a* of the running car 4 into the hopper 9.

Figure 27:
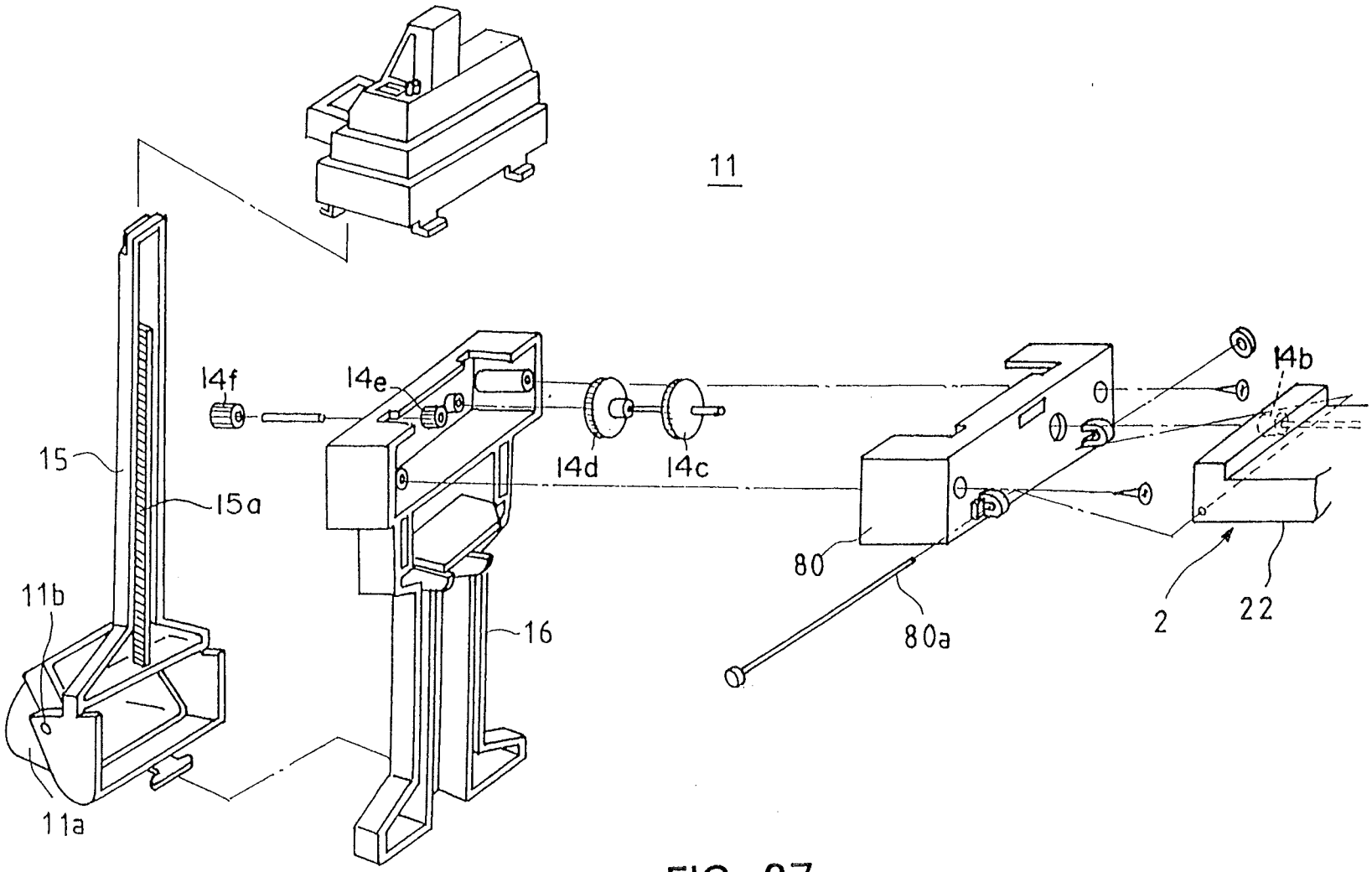
FIG. 27 is an exploded perspective view of the crane of the present invention.
Figure 28:
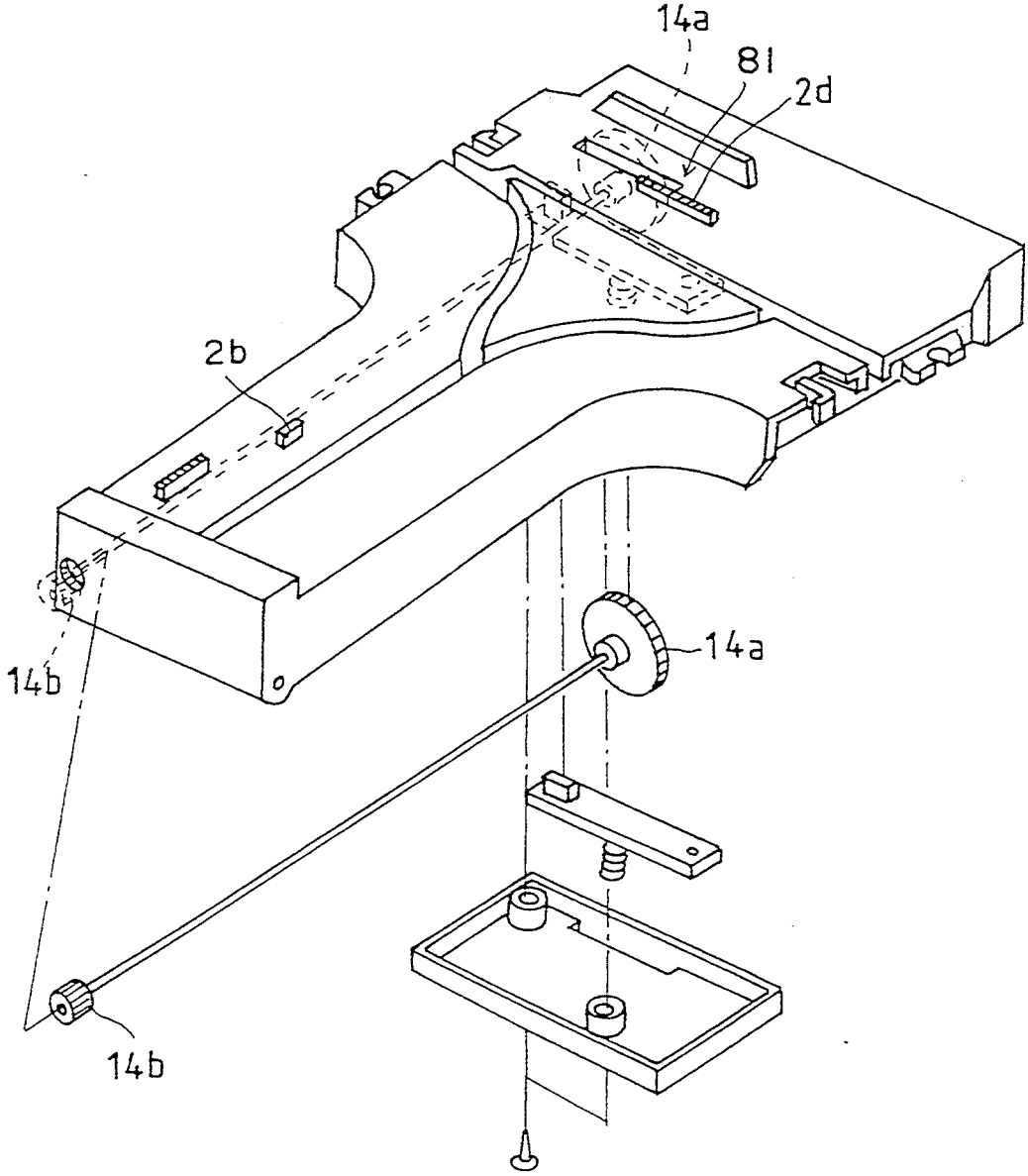
FIG. 28 is an exploded perspective view of the track and a portion of the crane driving mechanism.
Figure 29:
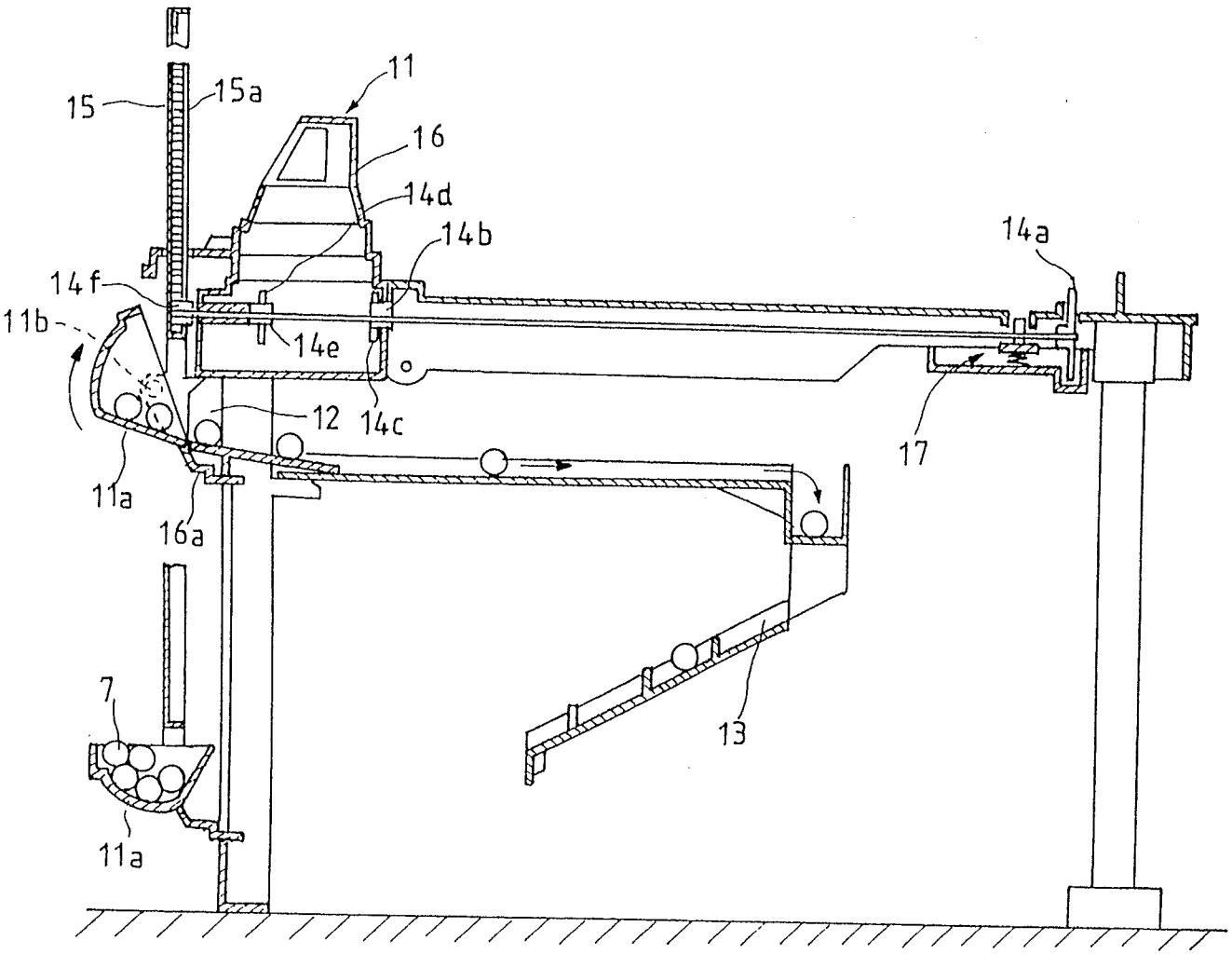
FIG. 29 is a side view, partly in section, of the crane and its driving mechanism in relationship to the running toy.

The crane 11 will now be described. The crane 11, as shown in FIG. 27, consists of a crane body 16 and an arm 15 supporting the bucket 11*a* provided with a rack 15*a* inside, and is mounted on the track 2 through a mounting member 80. The mounting member 80 is mounted on the track 2, and is rockable on the center of the shaft 80*a*, so that the mounting member 80 can be folded down to the track 2 to thereby facilitate the stowage of the toy. The crane 11 is operated by a driving mechanism 14 which will be described later. As shown in FIGS. 27–29, the bucket 11*a* is attached on the arm 15 in such a manner that it can rock on the center of the shaft 11*b*. When this arm 15 has moved up, the bucket 11*a* contacts the stationary part 16*a* in the crane body 16, thus turning to discharge the small balls 7 from the bucket 11*a* into the discharge port 12. The small balls 7 thus discharged into the discharge port 12 are guided rearward, and then are carried to the forward-backward switch section D through the slideway 13.

Figure 30:
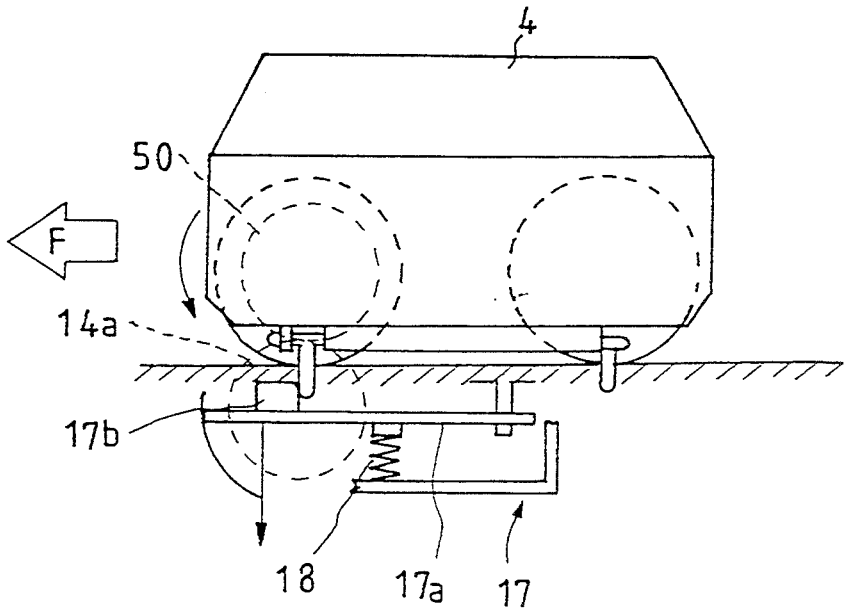
FIG. 30 is a side view of the running toy and trackway showing engagement between the stopper mechanism and the running car.
Figure 31:
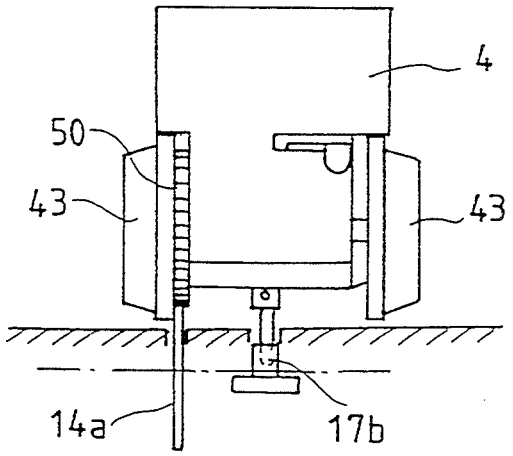
FIG. 31 is a front view of the running car and trackway showing engagement between the stopper mechanism and the running car.

The crane driving mechanism 14 will now be described. The track 2 behind the crane 11 is provided with a rack 2*d* and a gear 14*a*, as shown in FIGS. 25–28. Of these gears, the gear 14*a* is connected to the rack 15*a* through a pinion 14*b*, gears 14*c* and 14*d*, and pinions 14*e* and 14*f*, as shown in FIGS. 27–29. In the vicinity of the gear 14*a* there are provided a speed reducing section 81 and a stopper mechanism 17 to effectively operate the driving mechanism, thus reducing the speed of the running car 4 by the operation of the rack 2*c*. The stopper mechanism 17, as shown in FIG. 30, consists of a rocking plate 17*a* having a stopper 17*b* at the forward end, and a spring 18 for pushing the rocking plate 17*a* upward. During the period of rotation of the gear 14*a* which is driven by the drive gear 50 of the running car 4, the stopper 17*b* and the guide projection 45 are engaged to stop the running car 4, as shown in FIGS. 30 and 31. When the rotation of the gear 14*a* stops after the discharge of the small balls 7 from the bucket 11*a* of the crane 11 into the discharge port 12, the stopper 17*b* is forced downward by the guide projection 45 with the reaction of the turning force of the drive gear 50, starting the running car 4.

Although the elevator carrier 30 is moved up and down by the pinion and rack mechanism, as described above, to the child it appears as if the elevator 3 has detected the entry of the car 4 while ascending and descending, thus increasing the amusement value of the present invention.

Moreover, the arm 15 of the crane 11 is operated upward and downward by means of the pinion and rack mechanism providing for additional unprecedented motions.

It will be apparent from the foregoing that the scope of the present invention is not limited to the details of the preferred embodiment as described above. For example, it will be apparent that the arm 11*a* of the crane 11, while desired to move upward and downward, may be constructed to be transversely movable by the pinion-rack mechanism.

Although a preferred embodiment of the present invention has been described, it is to be understood that other embodiments may exist and changes made without departing from the spirit and scope of the invention.

What is claimed is:

1. A toy, comprising:

a trackway, a vehicle, power means for propelling said vehicle along said trackway, an action station, in the vicinity of said trackway, provided with a movable structure, means for stopping the vehicle at the action station, and means for activating movement of the movable structure by the power means of said vehicle, wherein said means for activating movement of said movable structure of said action station includes, a pinion on said action station driven by said power means of said vehicle, a rack provided within said action station which meshes with said pinion such that movement of said rack results in movement of said movable structure of said action station, and a crane, said rack being provided on said crane such that the movement of said pinion along the rack causes said crane to move.

2. A toy as in claim 1, further comprising an elevator having a housing provided with a vertically extending rack, and a carrier mounted to move up and down within said housing and normally positioned adjacent a section of said trackway such that said vehicle may enter said elevator on said carrier, said carrier being provided with a pinion operated by said power means of said vehicle, such that when said vehicle enters said elevator said pinion rotates along said rack of said elevator moving said elevator carrier and said vehicle and the vehicle exits the housing in the up and in the down position of the carrier.

3. A toy as in claim 1, further comprising:

at least one body complementary in configuration with respect to said vehicle such that it fits on top of said vehicle and is carried by said vehicle, and a mounting-dismounting section positioned within said trackway having walls projecting upwardly and being provided with supporting surfaces, such that as said vehicle carrying said body enters said mounting-dismounting section said body carried by said vehicle is deposited on said supporting surfaces as said vehicle moves through and leaves said section.

4. A toy, comprising:

a trackway, a vehicle, power means for propelling said vehicle along said trackway, an action station, in the vicinity of said trackway, provided with a movable structure, means for stopping the vehicle at the action station, and means for activating movement of the movable structure by the power means of said vehicle, wherein said action station includes, an elevator provided with a movably mounted carrier onto which said vehicle moves, said elevator having a first gear and a second gear and a pinion, meshing with a rack and driven by said power means through one of said first and second gears, said rack being provided within said elevator such that the continuous rotation of the pinion along the rack moves the elevator carrier and vehicle from the bottom to the top thereof when said first gear is engaged and from the top to the bottom when second gear is engaged.

5. A toy as in claim 4, further comprising:

at least one body complementary in configuration with respect to said vehicle such that it fits on top of said vehicle and is carried by said vehicle, and a mounting-dismounting section positioned within said trackway having walls projecting upwardly and being provided with supporting surfaces, such that as said vehicle carrying said body enters said mounting-dismounting section said body carried by said vehicle is deposited on said supporting surfaces as said vehicle moves through and leaves said section.

* * * * *